United States Patent [19]

Wright

[11] Patent Number: 4,558,532

[45] Date of Patent: Dec. 17, 1985

[54] RIFLE BENCHREST

[76] Inventor: Monte S. Wright, 445 Hedionda Ct., San Diego, Calif. 92117

[21] Appl. No.: 567,812

[22] Filed: Jan. 3, 1984

[51] Int. Cl.[4] ..... F41C 29/00

[52] U.S. Cl. ..... 42/94

[58] Field of Search ..... 42/94; 89/37 BA

[56] References Cited

U.S. PATENT DOCUMENTS

| | | | |
|---|---|---|---|
| 2,877,689 | 3/1959 | Pribis | 89/37 BA |
| 3,125,929 | 3/1964 | Peasley | 89/37 BA |
| 4,007,554 | 2/1977 | Helmstadter | 42/94 |
| 4,026,057 | 5/1977 | Cady | 42/94 |
| 4,055,017 | 10/1977 | Thompson | 42/94 |
| 4,449,314 | 5/1984 | Sorensen | 42/94 |

*Primary Examiner*—Charles T. Jordan

[57] ABSTRACT

This rifle benchrest is for improved accuracy in firing on targets. Primarily, it consists of a padded base with a pair of padded support posts, which enable quick and easy elevation adjustments of the rifle itself, and easy rifle sight elevation adjustments, as well.

1 Claim, 3 Drawing Figures

RIFLE BENCHREST

This invention relates to target shooting devices, and more particularly, to a rifle benchrest.

The principal object of this invention is to provide a rifle benchrest, which will be employed by serious benchrest target shooters, so as to prevent the instability often encountered with the use of benchrest devices of the prior art.

Another object of this invention is to provide a rifle benchrest, which will be completely stable in use, so as to enable the shooter to hold his rifle sights solidly and absolutely stationary on his target, while firing every round.

Another object of this invention is to provide a rifle benchrest, which will be unique, in that it will also serve to provide extreme satisfaction to the casual target shooter, and seasonal game hunter, who wishes to zero-in his or her hunting rifle, and bore-sighting, with a new and mounted rifle scope, will be surprisingly simple and fast for a shooter, the bore-sighting, for a rifle with iron sights, being equally simple and fast.

A further object of this invention is to provide a rifle benchrest, which will be excellent for the target shooter who wishes to develop the best target loads to keep a grouping of target hits within one half minute of angle, and the prior use of the present invention will be greatly appreciated later by hunters, when they bring down game with that all important first shot fired, and varmint hunters will be equally impressed by the use of the device, because they can employ it to stretch their kill shots to greater range distances, with more consistency.

A still further object of this invention is to provide a rifle benchrest, which will also be adaptable for ground use, with the shooter in the prone firing position, if a table is not available. However, in the abovementioned position, the shooter should be cautious of the recoil of large caliber rifles.

An even further object of this invention is to provide a rifle benchrest, which will be of such design, as to sight-in a handgun effectively.

Other objects are to provide a rifle benchrest, which is simple in design, inexpensive to manufacture, rugged in construction, easy to use, and efficient in operation.

These, and other objects, will be readily evident, upon a study of the following specification, and the accompanying drawing, wherein.

Figure 1:
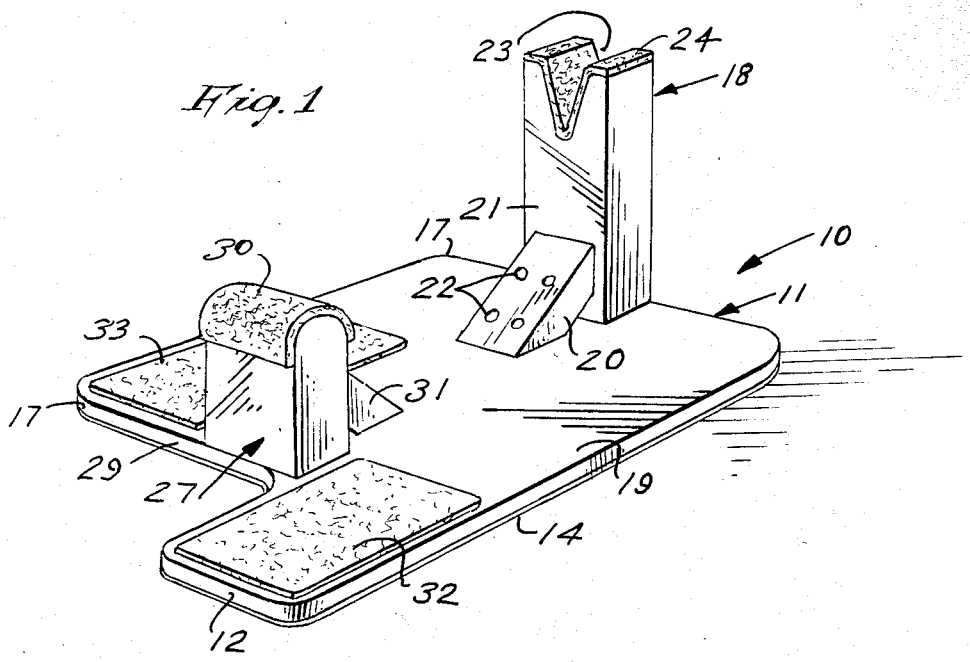
FIG. 1 is a perspective view of the present invention.
Figure 2:
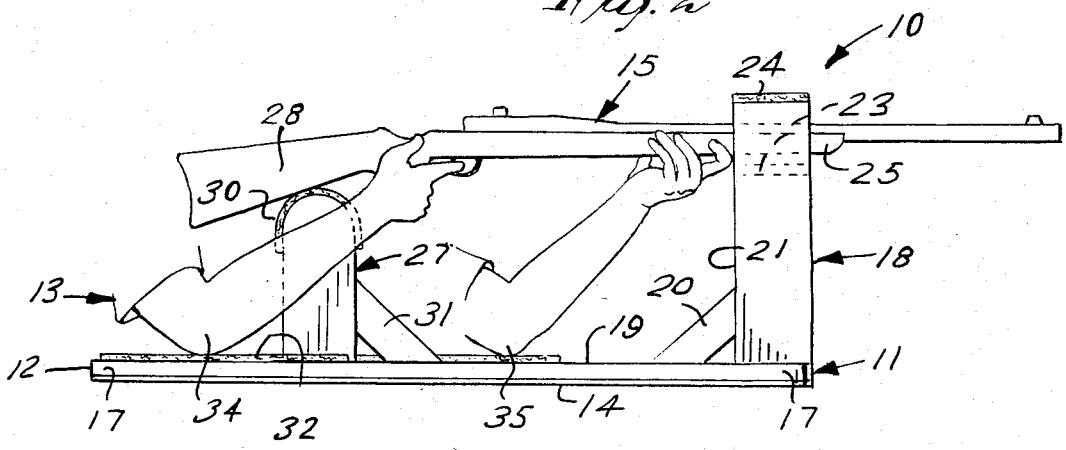
FIG. 2 is a side elevational view of FIG. 1, shown in use by a shooter.
Figure 3:
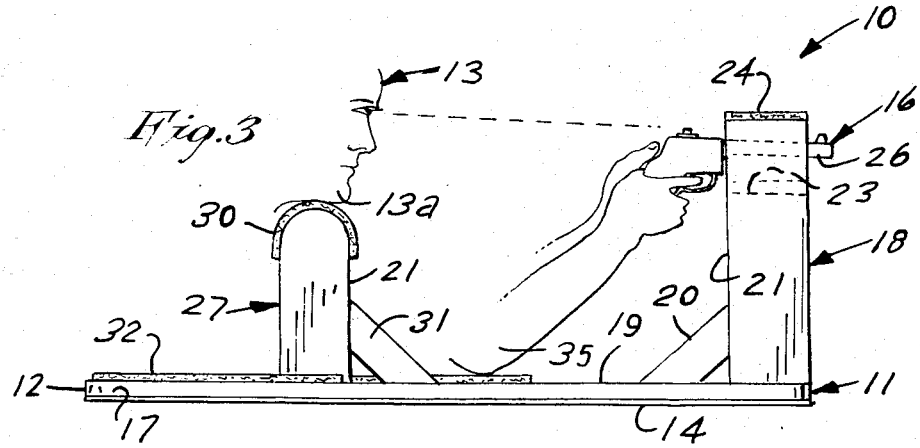
FIG. 3 is similar to FIG. 2, but illustrates the sighting-in of a handgun.

Accordingly, a benchrest device 10 is shown to include a base 11, which is fabricated of wood or other suitable material. Base 11 is substantially rectangular in configuration, and the right side thereof includes a rearward projection 12, which serves as an elbow rest for a shooter 13. A soft non-slip material 14, such as carpet, rubber or the like, is suitably secured to the bottom surface of base 11, so as to offer maximum resistance against movement of base 11 during sighting and firing of rifle 15 or handgun 16, and all of the corners 17 of base 11 are rounded, so as to enable ease of handling and transport of device 10. A front support post 18 is provided, and is fixedly secured to the top front surface 19 of base 11, by suitable fasteners (not shown), the bottom of post 18 being flush with the front peripheral edge of base 11, and centered on the top surface 19. A knee brace 20 is fixedly secured, at one end, to the rear surface 21 of post 18, and is fixedly secured, at its opposite end, to top surface 19, by means of suitable fasteners 22, for maximum rigidity. A "V"-shaped cut-out opening 23 is provided in the top end of support post 18. A radius of suitable dimension is provided on the top of cut-out opening 23, and also in the apex thereof, and a strip of soft non-slip material 24 is suitably adhered within opening 23 and the top surface of support post 18, for protectively and effectively holding the forestock 25 of rifle 15, or the barrel 26 of handgun 16. Cut-out opening 23 serves as a natural "V"-lock support for the forestock 25 or barrel 26, which will virtually prevent any vertical or horizontal movement, when the rifle 15 or handgun 16 is placed therein. A rear support post 27 is provided for support of the bottom of the rear stock portion 28, and the bottom end of post 27 is fixedly secured to surface 19 at the rear end 29 of base 11, by suitable fasteners (not shown). Post 27 aligns with post 18, and is covered on its rounded upper end by a soft strip of material 30, which is similar to the above-described 14 and 24, so as to give a non-slip and non-marring surface to rifle 15. A second knee brace 31 is provided, and is fixedly secured to the rear side of rear post 18, and the top surface 19 of base 11, by suitable fasteners (also not shown). Another strip of material 32 is suitably secured to the top of projection 12, and a further strip of material 33 is secured to surface 19 on the left side of post 27, and are similar to 14, 24, and 30, so as to provide cushioning comfort for the elbows 34 and 35 of the shooter 13.

It shall be noted that, for left handed shooters, base 11 may be modified to have its projection 12 on the left side of base 11, for support of the left elbow 35, rather than on the right side, as illustrated.

In use, device 10 is, first, placed in the desired position on the table or other surface, with post 18 forward, towards the target. When used on a table, the shooter 13 sits in a chair directly behind device 10, and the shooter 13 places the fore-end or forestock 25 in the opening 23 of the front support post 18. The rear stock portion 28 is rested on top of the rear support post 27, and the natural incline of the stock enables the shooter 13 to push rifle 15 forward, or pull it rearward, to effect fine adjustments in line-of-sight elevation. When effecting rough elevation changes, a one-half times thirty inch wooden dowel may be employed, by placing it in varied positions under the front or rear of base 11, and, in extreme elevation inclines, special arrangements must be created by the shooter 13 himself, so as to cope with any given situation, such as when dealing with uphill and downhill varmint hunting.

When using device 10 for sighting-in a handgun 16, the shooter 13 holds handgun 16 with both hands, and places barrel 26 in opening 23, at rest therein. The elbows 34 and 35 are then placed into comfortable positions on the pad materials 32 and 33, and the chin **13*a* of the shooter 13 is rested on the top of rear support post 27. Shooter 13 is then ready to squeeze off round after round at the target, to determine the desired sight alignment, and, when using device 10** for handguns, extreme caution should be exercised against dangerous recoil, when firing large caliber handguns.

While various changes may be made in the detail construction, it is understood that such changes will be within the spirit and scope of the present invention, as is defined by the appended claims.

I claim:

1. A rifle benchrest, comprising, in combination, a horizontal, flat base, a rearward extension of one side portion of said base, a soft non-slip pad upon said extension and another soft non-slip pad upon a rear end of an opposite side portion of said base, an upright, front support post and an upright, rear support post mounted upon said base, a "V"-shaped notch upon an upper end of said front support post, a soft non-slip pad lining said "V"-shaped notch, and an upper end of said rear support post being rounded with a semicylindrical, transverse extending surface covered by another soft non-slip pad.

* * * * *

UNITED STATES PATENT AND TRADEMARK OFFICE

CERTIFICATE OF CORRECTION

PATENT NO. : 4,558,532

DATED : December 17, 1985

INVENTOR(S) : Rifle Benchrest

It is certified that error appears in the above-identified patent and that said Letters Patent is hereby corrected as shown below:

On the title page:

Item [76] Inventor's address reading "445 Hedionda Ct., San Diego, Calif. 92117" should read -- 4425 Hedionda Ct., San Diego, Calif. 92117.

Signed and Sealed this

*Eighteenth* Day of *March 1986*

[SEAL]

*Attest:*

DONALD J. QUIGG

*Attesting Officer*

*Commissioner of Patents and Trademarks*